US007116296B2

(12) United States Patent
Chiu et al.

(10) Patent No.: US 7,116,296 B2
(45) Date of Patent: Oct. 3, 2006

(54) LAYOUT METHOD FOR IMPROVING IMAGE QUALITY

(75) Inventors: Chaung-Ming Chiu, Taoyuan (TW); Ming-Da Chung, Pingtung (TW)

(73) Assignee: TPO Displays Corp., Chu-Nan (TW)

( * ) Notice: Subject to any disclaimer, the term of this patent is extended or adjusted under 35 U.S.C. 154(b) by 318 days.

(21) Appl. No.: 10/250,005

(22) Filed: May 28, 2003

(65) Prior Publication Data

US 2004/0130519 A1 Jul. 8, 2004

(30) Foreign Application Priority Data

Jan. 7, 2003 (TW) ..... 92100218 A

(51) Int. Cl.
*G09G 3/36* (2006.01)

(52) U.S. Cl. ..... 345/87; 345/98

(58) Field of Classification Search ..... 345/87, 345/88, 89, 90, 91–100, 101–103, 204, 83, 345/84, 501, 520, 530
See application file for complete search history.

(56) References Cited

U.S. PATENT DOCUMENTS

| | | | | |
|---|---|---|---|---|
| 5,191,647 | A * | 3/1993 | Masaki | 345/501 |
| 5,426,447 | A * | 6/1995 | Lee | 345/103 |
| 5,523,773 | A * | 6/1996 | Arakawa et al. | 345/98 |
| 5,714,985 | A * | 2/1998 | Kawamura et al. | 345/520 |
| 6,337,677 | B1 * | 1/2002 | Higashi | 345/100 |
| 6,522,317 | B1 * | 2/2003 | Satou et al. | 345/98 |
| 6,703,994 | B1 * | 3/2004 | Edwards | 345/87 |
| 6,762,754 | B1 * | 7/2004 | Murade | 345/204 |

* cited by examiner

*Primary Examiner*—Nitin Patel
(74) *Attorney, Agent, or Firm*—Liu & Liu

(57) ABSTRACT

A layout method for improving image quality, suitable for use in a display. The display has a plurality of pixels and a plurality of control circuits. The pixels and the control circuits are divided into several sections, each having a plurality of data lines connected to a plurality of image input lines. The layout method is characterized in that between two consecutive sections, the image input line connected to the last data line of the front section is located in proximity of the data line connected to the image input line connected to the first data line of the rear section. Therefore, loads applied to the image input lines of the consecutive sections are not too much different from each other, and the image non-uniformity is thus improved.

20 Claims, 3 Drawing Sheets

LAYOUT METHOD FOR IMPROVING IMAGE QUALITY

CROSS REFERENCE TO RELATED APPLICATIONS

This application claims the priority benefit of Taiwan application serial no. 92100218, filed Jan. 7, 2003.

BACKGROUND OF INVENTION

1. Field of the Invention

The present invention relates in general to an image layout method, and more particularly, to a layout method image quality.

2. Description of the Related Art

The earliest dynamic image visible to human beings was the documentary movie. With the invention of the cathode ray tube (CRT), commercial television has become a necessary home appliance. The development of science and technology has further extended the application of the cathode ray tube into the desktop monitor of the computer industry for the last several decades. However, as various kinds of cathode ray tubes suffer from radiation problems, and the internal electron gun occupies such a large volume, the cathode ray tube has become inapplicable for thin and light products.

The above problems thus initiated the development of flat panel display, such as the liquid crystal display (LCD), field emission display (FED), organic light emitting diode (OLED), and plasma display panel (PDP). Among the above displays, the development of the liquid crystal display is most significant. The liquid crystal display possesses the characteristics of thinness, smallness, lightness and applicability of small, medium and large area display, and has been applied to the portable wireless communication and network techniques.

The image layout method is a key feature determining the quality of the image displayed by the liquid crystal display. Referring to FIG. 1, a layout of a liquid crystal display is illustrated. As shown in FIG. 1, the liquid crystal display 10 includes a data line driving circuit 102, a scan line driving circuit 104, data lines 106 and scan lines 108. The intersection of each data line 106 and each scan line 108 constructs a pixel. In FIG. 1, the application specific integrated circuit (ASIC) 14 is connected to the data lines 106 via the image input lines 16 to drive the liquid crystal display 10. Further, the layout method connecting the image input lines 16 with the data lines 106 affects the image quality of the liquid crystal display 10. When the number of the image input lines 16 is increased, the product of the resistance and capacitance (RC) of the wiring layout of the image input lines 16 is crucial, to affecting the driving capacity of the application specific integrated circuit 14. Therefore, the power consumption of the application specific integrated circuit is affected. On the other hand, when the number of the image input lines 16 is increased, the load difference between image input lines 16 is also crucial and will cause a non-uniform image.

FIG. 2 shows a conventional image layout. In FIG. 2, there are n image input lines. The liquid crystal display includes the pixels 202, the control circuits 204, and n data lines in a single section. As shown in FIG. 2, the data lines are sequentially arranged and connected to the image data lines. That is, the first data line is connected to the first image input line, the second data line is connected to the second image input line, and the nth data line is connected to the nth image input line. Alternatively, in FIG. 2, the data lines can be arranged and connected to the image input lines in a reverse sequence. That is, the first data line is connected to the nth image input line, the second data line is connected to the last second image input line, and the nth data line is connected to the first image input line. Further, as shown in FIG. 2, the first image input line has 0 cross overlap, the second image input line has 1 cross overlap, and consequently, the nth image input line has n−1 cross overlaps. Each cross overlap generates an overlap capacitor. The larger the overlap capacitor is, the more difficult it is to drive the application specific integrated circuit. For such a conventional layout, as each image input line has different numbers of cross overlaps, therefore, the application specific integrated device requires a different driving power to drive each image input line.

In another image layout as shown in FIG. 3, there are n image input lines, and the liquid crystal display includes a plurality pixels and a plurality of control circuits. The pixels and control circuits are divided into a first section 304 to an mth (m is a positive integer) section 304. The first section comprises the first pixels 306, the first control circuits 308 and n (n is a positive integer) data lines 310. Similarly, the mth section 304 includes the mth pixels 312 and the mth control circuits 314 and n data lines 316. For a quarter common intermediate format (QCIF), there are m=176 Ã□3/n for n image input lines.

As shown in FIG. 3, the data lines in each section are connected to the image input lines with a reverse sequence. That is, the nth data line is connected to the first image input line, the (n−1)th data line is connected to the first image input line, and the first data line is connected to the nth data line. In addition, in FIG. 3, the data lines can also be connected to the image input lines sequentially. That is, the first data line is connected to the first image input line, the second data line is connected to the second image input line, and the nth data line is connected to the nth image input line. As shown in FIG. 3, the numbers of cross overlaps of the first, second and third image input lines are 0, 1 Ã□m and 2 Ã□m. Consequently the nth image input line has (n−1)Ã□m m cross overlaps. With such a conventional layout, the number of cross overlaps for each image input line is different, causing different load and overlap capacitance. Therefore, the application specific integrated circuit requires a different driving power to drive each image input line. Further, between two consecutive front and rear sections, the nth data line of the front section is connected to the first image input line, while the first data line of the rear section is connected to the nth image input line. As the number of cross overlaps between the connected data lines and the image input lines varies too much, the images displayed by two neighboring sections contain a gap, seriously affecting the image quality.

SUMMARY OF INVENTION

The present invention provides a layout method for improving image quality. The present invention is characterized in locating the image input line connected to the last data line in a front section in a proximity of the image input line connected to the first data line in the neighboring rear section. Therefore, the load difference between the neighboring sections is reduced, such that the uniformity of the image is improved.

The layout method provided by the present invention comprises the following steps. The layout method is applicable for a display that comprises a plurality of pixels and a plurality of control circuits. The pixels and control circuits are divided into a plurality of sections.

The data lines in each section are connected to the image input lines. The layout method is characterized by locating the image input line connected to the last data of the front section in proximity of the image input line connected to the first data line in the following section.

In one embodiment of the present invention, other image input lines are neighboring to the image input line.

Preferably, the number of the data lines is the same as the number of the image input lines.

Further, the number of the sections is determined according to the number of the pixels and the number of the image input lines.

In one embodiment of the present invention, the image input lines are connected to the application specific integrated circuit.

The display includes a liquid crystal display such as a low-temperature polysilicon thin-film transistor liquid crystal display or non-amorphous thin-film transistor liquid crystal display.

The present invention further provides a layout method for improving image quality suitable for use in a display comprising a plurality of pixels and control circuits. In the layout method, the pixels and the control circuits are divided into a plurality of sections. Each section includes a plurality of data lines. Each data line is connected to a corresponding image input line. Between two neighboring sections, when the first image input line is connected to the last data line of the front section, the first data line of the rear section is connected the second image input line proximate to the first image input line.

In this embodiment, the second image line is neighboring to the first image input line.

According to the above, the present invention is characterized in locating another image input line connected to the first data line of the rear section in proximity of the image input line connected to the last data line of the front section. Therefore, the load difference between the neighboring image input lines is reduced, such that the image uniformity is improved.

BRIEF DESCRIPTION OF DRAWINGS

The above objects and advantages of the present invention will be become more apparent by describing in detail exemplary embodiments thereof with reference to the attached drawings.

DETAILED DESCRIPTION

Figure 1:
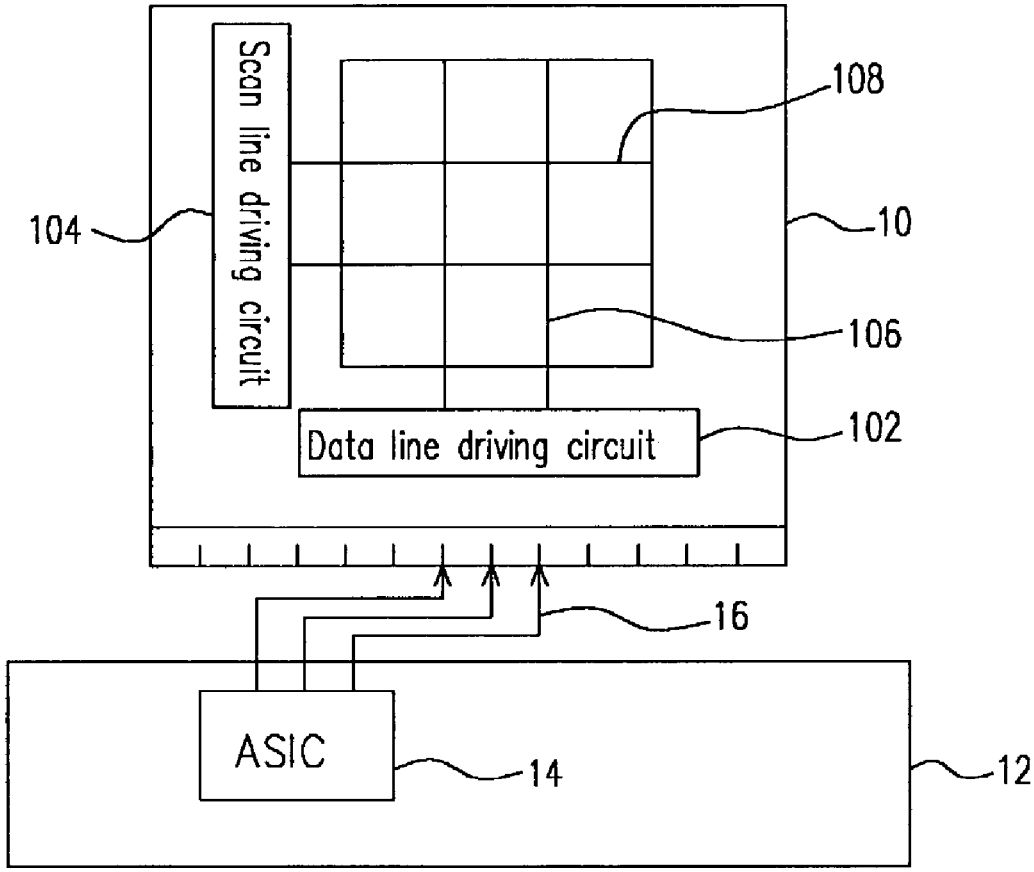
FIG. 1 (PRIOR ART)
FIG. 1 shows a layout of a liquid crystal display.
Figure 2:
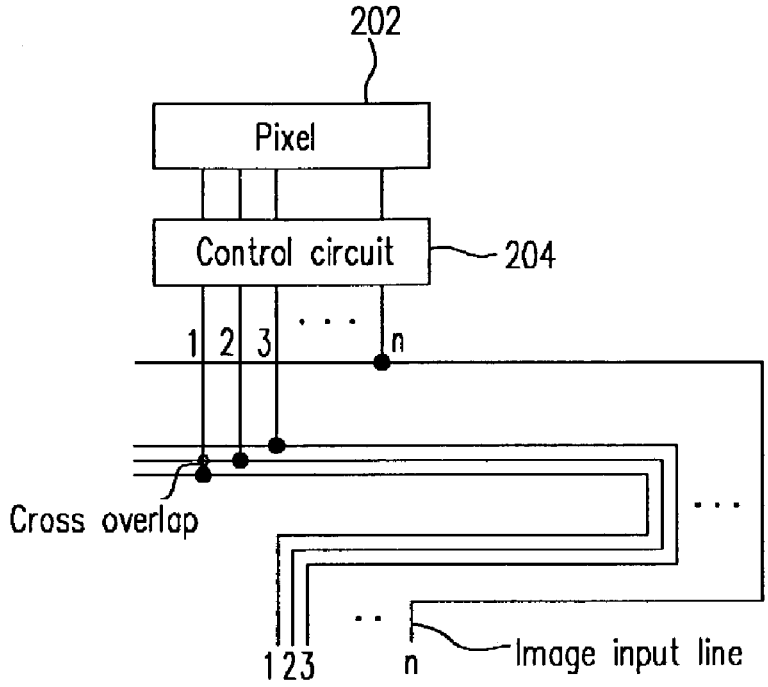
FIG. 2 (PRIOR ART)
FIG. 2 shows a conventional image layout.
Figure 3:
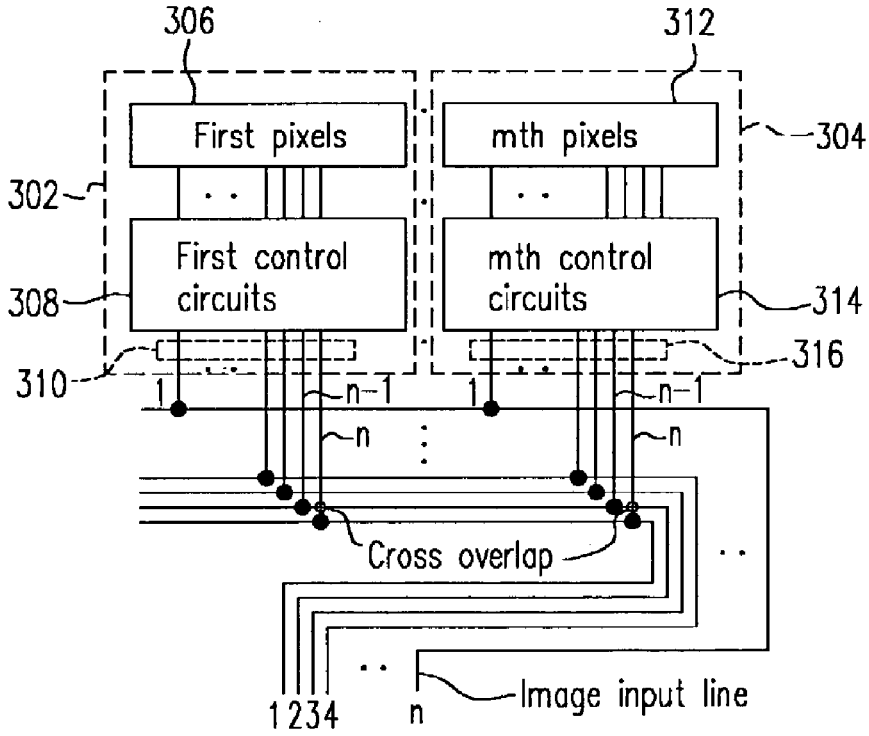
FIG. 3 (PRIOR ART)
FIG. 3 shows another conventional image layout.
Figure 4:
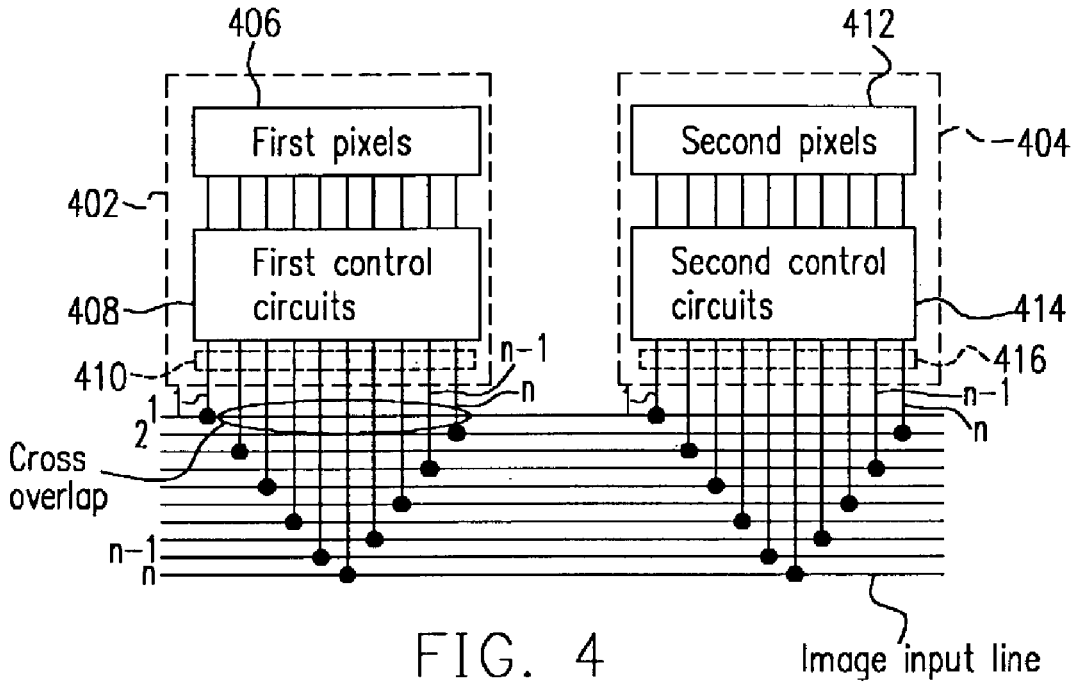
FIG. 4 shows a layout for improving the image quality according to one embodiment of the present invention.

FIG. 4 shows a layout for improving image quality according to one embodiment of the present invention. The layout can be applied to a display such as a low-temperature polysilicon thin-film transistor liquid crystal display or amorphous silicon thin-film transistor liquid crystal display. In FIG. 4, there are n image input lines connected to the application specific integrated circuits, while the display comprises a plurality of pixels and control circuits.

The layout illustrated in FIG. 4 is used as an example to describe the present invention. In the layout method, the pixels 402 and the control circuits are divided into a first section 402 and a second section 404. The first section 402 comprises first pixels 406, first control circuits 408 and n (n is a positive integer) data lines 410.

Similarly, the second section 404 comprises second pixels 412, second control circuits 414 and n data lines 416. For a quarter common intermediate format, when there are n image input lines, the number of the sections is 176 Ã□3/n . Therefore, the number of sections is determined according to the numbers of pixels and image input lines.

Each of the data lines of the first and second sections 402 and 404 is connected to the corresponding image input line. Between the first section 402 and the second section 404, if the nth data line of the first section 402 is connected to one of the n image input lines, the first data line of the second section 404 is connected to another image data line in proximity of the image data line. Preferably, this other image data line is neighboring to the one image data line to obtain a better image quality. In this embodiment, the nth data line of the first section 402 is connected to the second image input line, while the first data line of the second section 404 is connected to the first image input line neighboring to the second image input line. Therefore, the number of cross overlap of the n data lines in the first section 402 and the second image input line is (n−2)Ã□2, which has the least difference from the number of cross overlaps (n−1)Ã□2 of the first data line of the second section 404 and the first image input line. Therefore, the gap of the images displayed by neighboring sections to improve image quality. It is appreciated that, other than the specific layout for the nth data line of the first section 402 and the first data line of the second section 404, layout for other data lines can be implemented by various methods as long as the corresponding image input lines are connected.

Figure 5:
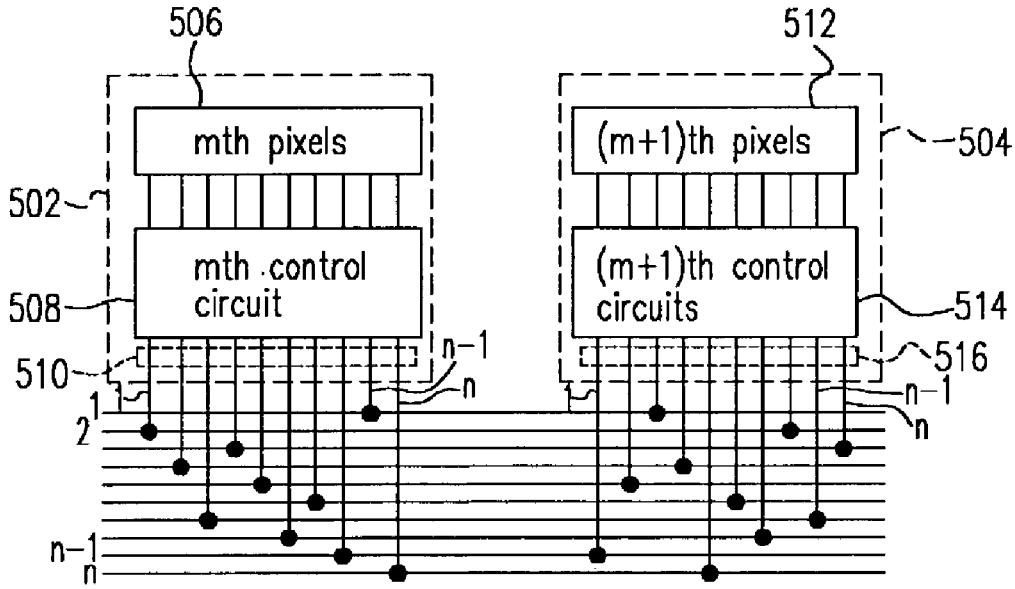
FIG. 5 shows a layout for improving the image quality according to another embodiment of the present invention.

FIG. 5 shows a layout method improving image quality in another embodiment of the present invention. In FIG. 5, there are n image input lines connected to the application specific integrated circuits, while the display comprises a plurality of pixels and control circuits.

Each of the data lines of two consecutive neighboring mth and (m+1)th sections 502 and 504 is sequentially connected to the corresponding image input lines. Between two consecutive neighboring mth section 502 and the (m+1)th section 504, if the nth (i.e. the last) data line of the front section 502 is connected to one of the n image input lines, the first data line of the (m+1)th rear section 504 is connected to a image input line in proximity of the image input line which is connected to the nth data line of the front section 502. Preferably, this other image data line is neighboring to the one image data line to obtain a better image quality. In this embodiment, the nth data line of the mth section 502 is connected to the nth image input line, while the first data line of the (m+1)th section 504 is connected to the (n−1)th image input line neighboring to the nth image input line. Therefore, the number of cross overlaps of the nth data lines in the mth section 502 and the (n−1)th image input line is 0, which has the least difference from the number of cross overlap 2 of the mth data line of the (m+1) (th section 504 and the mth image input line. Therefore, the gap of the images displayed by neighboring sections improves image quality. It is appreciated that, other than the specific layout for the nth data line of the mth section 502 and the first data line of the (m+1)th section 504, layout for other data lines can be implemented by various methods as long as the corresponding image input lines are connected.

Each of the data lines of the mth and (m−1)th sections 502 and 504 is connected to the corresponding one among the n image input lines. Between the mth section 502 and the (m+1)th section 504, if the nth data line of the first section 502 is connected to one of the n image input lines, the first data line of the (m+1)th section 504 is connected to another image data line in proximity of the one image data line. Preferably, this other image data line is neighboring to the one image data line to obtain a better image quality. In this embodiment, the nth data line of the mth section 502 is connected to the nth image input line, while the first data line of the (m+1)th section 504 is connected to the (n−1)th image input line neighboring to the nth image input line. Therefore, the number of cross overlaps of the nth data lines in the mth section 502 and the (n−1)th image input line is 0, which has the least difference from the number of cross overlap 2 of the mth data line of the (m−1)th section 504 and the mth image input line. Therefore, the gap of the images displayed by neighboring sections improves image quality. It is appreciated that, other than the specific layout for the nth data line of the mth section 502 and the first data line of the (m+1)th section 504, layout for other data lines can be implemented by various methods as long as the corresponding image input lines are connected.

According to the above, the present invention is characterized in locating one image input line connected to the last data line of the front section in proximity of another image input line connected to the first data line of the rear section neighboring to the front section, such that the load difference between neighboring image input lines is minimized, and the image uniformity is improved.

While the present invention has been particularly shown and described with reference to preferred embodiments thereof, it will be understood by those of ordinary skill in the art that various changes in form and details may be made therein without departing from the spirit and scope of the present invention as defined by the appended claims.

The invention claimed is:

1. A layout method of improving image quality, of a display that comprises a plurality of sections including a first section and an adjacent second section, each section comprising a plurality of pixels operatively coupled to a control circuit, and a plurality of data lines including a first data line and a last data line in each of the first section and the second section, wherein the first data line in the second section is adjacent to the last data line in the first section, the layout method comprising:

providing a plurality of image input lines with a spacing between adjacent image input lines; and connecting the last data line in the first section to one of the plurality of image input lines and the first data line in the second section to another one of the plurality of image input lines, and wherein said one of the plurality of image input lines and said another one of the plurality of image input lines are spaced less than total spacing between all the image input lines.

2. The method as claimed in claim 1, wherein said another one of the plurality of image input lines is neighboring to said one of the plurality of image input lines.

3. The method as claimed in claim 1 wherein the number of the data lines is the same as the number of the image input lines.

4. The method as claimed in claim 1, wherein the number of the sections is determined according to the numbers of the pixels and the control circuits.

5. The method as claimed in claim 1, wherein the image input lines are connected to an application specific integrated circuit.

6. The method as claimed in claim 1, wherein the display includes a liquid crystal display.

7. The method as claimed in claim 6, wherein the liquid crystal display includes a low-temperature polysilicon thin-film transistor liquid crystal display.

8. The method as claimed in claim 6, wherein the liquid crystal display includes an amorphous silicon thin-film transistor liquid crystal display.

9. A layout method of improving image quality of a display, comprising:

partitioning the display into a plurality of sections to include at least a first section and an adjacent second section, wherein each section comprises a plurality of pixels operatively coupled to a control circuit, and a plurality of data lines including a first data line and a last data line in the first section and a first data line and a last data line in the second section, wherein the first data line in the second section is adjacent to the last data line in the first section;

providing a plurality of image input lines with a spacing between adjacent image input lines;

connecting each data line within the first section and the second section to the plurality of image input lines, wherein the last data line in the first section is connected to one of the plurality of image input lines and the first data line in the second section is connected to another one of the plurality of image input lines, and wherein said one of the plurality of image input lines and said another one of the plurality of image input lines are spaced less than total spacing between all the image input lines.

10. The method as claimed in claim 9, wherein said another one of the plurality of image input lines is neighboring to said one of the plurality of image input lines.

11. The method as claimed in claim 9, wherein the number of the data lines is the same as the number of the image input lines.

12. The method as claimed in claim 9, wherein the number of the sections is determined according to the number of the pixels and the control circuits.

13. The method as claimed in claim 9, wherein the image input lines are connected to an application specific integrated circuit.

14. The method as claimed in claim 9, wherein the display includes a liquid crystal display.

15. The method as claimed in claim 14, wherein the liquid crystal display includes a low-temperature polysilicon thin-film transistor liquid crystal display.

16. The method as claimed in claim 14, wherein the liquid crystal display includes an amorphous silicon thin-film transistor liquid crystal display.

17. A connection layout of a display, wherein the display comprises at least one section that comprises a plurality of pixels operatively coupled to a control circuit, the connection layout comprising:

a plurality of data lines;

a plurality of image input lines with a spacing between adjacent image input lines;

wherein each data line is connected to a different one of the plurality of image input lines, including one of said plurality of data lines being connected to one of said plurality of image input lines and another one of said plurality of data lines being connected to another one of said plurality of image input lines, wherein said one of the plurality of image input lines and said another one of the plurality of image input lines are spaced less than total spacing between all the image input lines.

18. The connection layout of claim 17, wherein the display comprises more than one section, and wherein each section comprises the same connection layout connecting the data lines to the image input lines.

19. The connection layout of claim 17, wherein said one of the plurality of image input lines is adjacent to said another one of the plurality of image input lines.

20. The connection layout of claim 17, wherein the image input lines comprise sequential image input lines 1 to n, and said another one of the plurality of image input lines is between the image input line 1 and the image input line n.

* * * * *